US005548264A

United States Patent [19]

Teshima et al.

[11] Patent Number: 5,548,264

[45] Date of Patent: Aug. 20, 1996

[54] COIL DEVICE

[75] Inventors: Katsuyoshi Teshima, Fukuoka; Hideo Kamoshita, Tokyo; Masaaki Baba, Fukuoka, all of Japan

[73] Assignee: Mitsumi Electric Co., Ltd., Tokyo, Japan

[21] Appl. No.: 380,861

[22] Filed: Jan. 30, 1995

[30] Foreign Application Priority Data

Jan. 31, 1994 [JP] Japan ..... 6-029004

[51] Int. Cl.[6] ..... H01F 15/10; H01F 27/30

[52] U.S. Cl. ..... 336/65; 336/83; 336/192

[58] Field of Search ..... 336/65, 83, 192; 310/71

[56] References Cited

U.S. PATENT DOCUMENTS 3,711,805 1/1973 Heijnen et al. ..... 336/65

3,859,614 1/1975 Reithmaier ..... 336/192

4,769,625 9/1988 Meindl ..... 336/192

FOREIGN PATENT DOCUMENTS 3-241711 10/1991 Japan ..... 336/192

*Primary Examiner*—Thomas J. Kozma

*Attorney, Agent, or Firm*—Whitham, Curtis, & Whitham & McGinn

[57] ABSTRACT

A coil device includes an insulating board, a drum core disposed on the board, the drum on which a coil is wound, at least one lead terminal passing through the insulating board from the bottom surface of the insulating board, the lead terminal projecting sideways, and an adhesive layer interposed between the insulating board and the drum core, the lead terminal projecting sideways positioned in the adhesive layer.

6 Claims, 4 Drawing Sheets

COIL DEVICE

BACKGROUND OF THE INVENTION

1. Field of the Invention

The invention relates to a coil device having a drum core disposed on a board, the drum core having a coil formed thereon and the board having a lead terminal.

2. Related Art

FIG. 3 is a sectional view of a conventional coil device 1. In FIG. 3, reference numeral 2 denotes a ring core made of a magnetic material such as ferrite; 3, a drum core having collars 3*a*, 3*c* and a winding part 3*b* and being made of a magnetic material such as ferrite; 4, a coil formed on the winding part 3*b*; 5, an insulating board having a lead terminal 6; and 7, an adhesive for fixing the drum core 3 to the board 5. Here, an end part 4*a* of the coil 4 is connected to a front end part 6*a* of the lead terminal 6 that is bent midway.

While the lead terminal 6 is usually fixed to the board 5 by insert molding, once a strong force has been applied to the lead terminal 6 in a direction indicated by an arrow A, the end part 6*a* thereof is moved in a direction indicated by an arrow B. As a result, a tensile force is produced at the end part 4*a* of the coil 4, thereby breaking the coil 4.

A conventional coil of this type is also constructed as shown in, e.g., FIGS. 4 and 5. That is, in FIGS. 4 and 5, a coil device 101 includes: a board 102 made of an insulating material; a drum core 103 being fixed to the top surface of the board 102 and made of a magnetic material such as ferrite; a coil 104 formed on a winding part 103*c* between upper and lower collars 203*a*, 203*b* of the drum core 103; a pot core 105 enclosing the drum core 103 and having an open space at a lower end; and a plurality of lead terminals 106 (three in the case shown in FIGS. 4 and 5) inserted into the board 102 so as to project toward one side (leftward in the case of FIGS. 4 and 5) from the bottom of the board 102 while passing through the board 102.

The winding lead terminal of the coil 104 is led out sideways from the pot core 105 through the open space 105*a* provided at the lower end of the pot core 105 so as to be bound up around an end part 106*a* projecting sideways from the lead terminal 106.

However, in the thus constructed coil device 101, the end part 106*a* of each lead terminal 106 projecting sideways must have a certain length so that the winding lead terminal of the coil can be bound up around the end part 106*a*. Therefore, the end part 106*a* projects sideways by a relatively large length from the board 102 and the pot core 105. When this coil device 101 is to be mounted on a mounting board for forming circuits of various devices, the substantial mounting area is increased since the end part 106*a* of each lead terminal 106 projects by a large length. This makes the mounting board large in structure, thus running counter to the needs for downsizing the mounting board.

SUMMARY OF THE INVENTION

In view of the aforementioned circumstances, an object of the invention is to provide a coil device in which electrical connection between the coil and the lead terminal is reliably maintained even if a strong force is applied to the lead terminal.

Another object of the invention is to provide a coil device in which the end part of the lead terminal projects by a relatively large length.

Still another object of the invention is to provide a coil device in which an intermediate part of the lead terminal is bent on the board, and the board, the drum core, and the intermediate part of the lead terminal are adhesively fixed together while interposing an adhesive between the board and the drum core in a coil device in which the drum core with a coil formed thereon is disposed on the board having the lead terminal.

The above objects can be achieved by a coil device having a coiled drum core disposed on a board and having at least one lead terminal projecting sideways while passing through the board from a bottom surface of the board, wherein an end part of the lead terminal projecting sideways is bent downward.

It is preferred that a coil device of the invention have an open space provided on a lateral side of the board toward which the end part of the lead terminal projects.

It is further preferred that a coil device of the invention have an end part of the lead terminal projecting sideways bent obliquely downward.

It is still further preferred that a coil device of the invention have an end part of the lead terminal projecting sideways bent perpendicularly downward.

Even if a strong force is applied to the lead terminal, the aforementioned coil device can ensure reliable electrical connection between the coil and the lead terminal by blocking the movement of the front end part of the lead terminal and thereby preventing unnecessary tensile force from being produced at the end part of the coil.

The aforementioned construction is characterized as bending downward the end part of the lead terminal that projects sideways from the board, the end part being bound up by the winding lead terminal of the coil formed on the drum core. Therefore, the length by which the lead terminal projecting sideways from the board is shortened. As a result of this construction, when the coil device is to be mounted on a mounting board, the substantial mounting area can be reduced.

In the case where an open space is provided on a lateral side of the board from which the end part of the lead terminal projects, the end part of the lead terminal is bent downward within the open space. Therefore, the end part of the lead terminal either slightly projects sideways from the board or the pot core, or does not project at all. Hence, the substantial mounting area can be further reduced.

Further, in the case where the end part of the lead terminal projecting sideways is bent so as to extend obliquely downward, not only the lead terminal can be bent with ease, but also the winding lead terminal of the coil can be bound up around the end part of the lead terminal with ease as well.

Still further, in the case where the end part of the lead terminal projecting sideways is bent so as to extend perpendicularly downward, the length by which the end part of the lead terminal projects sideways from the board can be minimized. Therefore, the substantial mounting area can be further reduced.

DETAILED DESCRIPTION OF THE PREFERRED EMBODIMENTS

Figure 1:
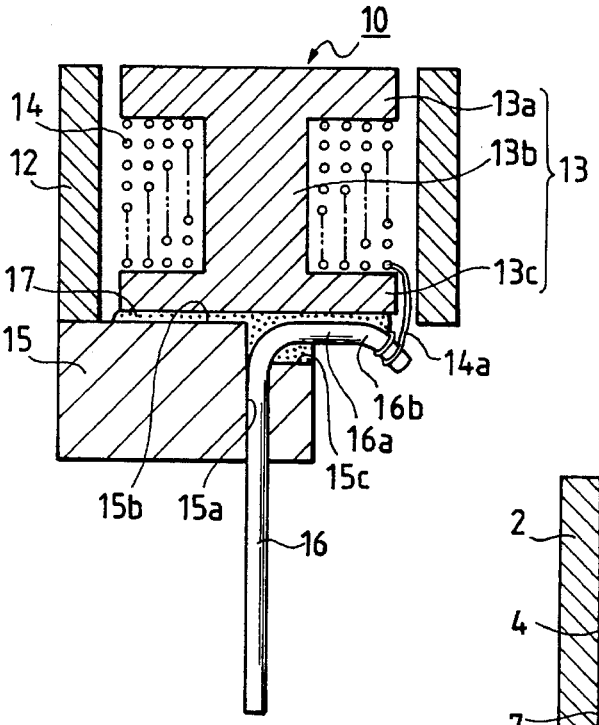
FIG. 1 is a sectional view of a coil device, which is a first embodiment of the invention.
Figure 3:
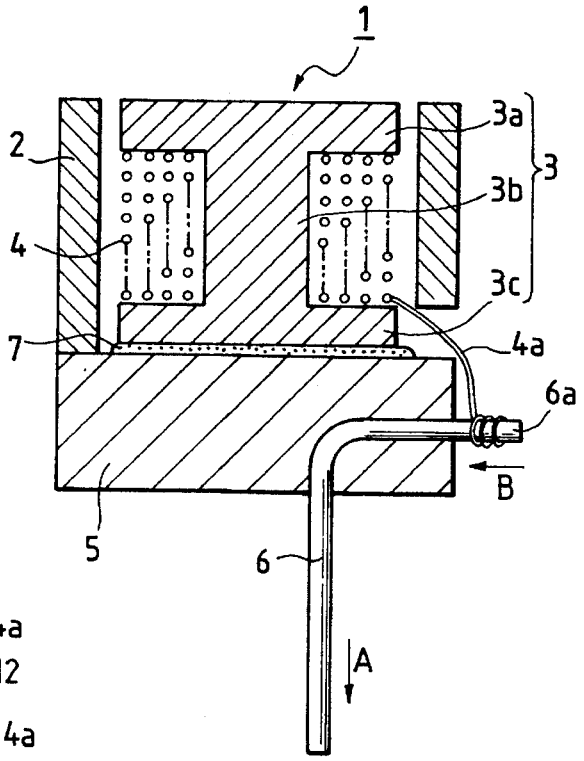
FIG. 3 PRIOR ART
FIG. 3 is a sectional view of a conventional coil device.
Figure 2:
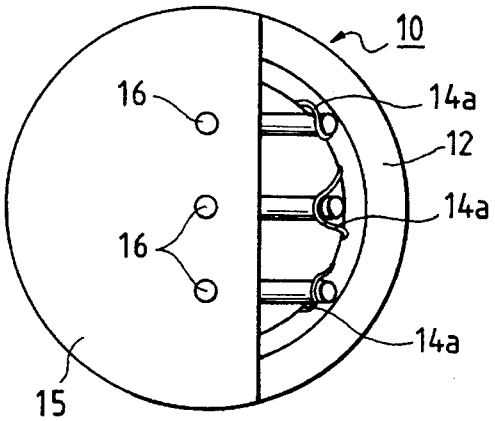
FIG. 2 is a bottom view of the coil device of FIG. 1.
Figure 4:
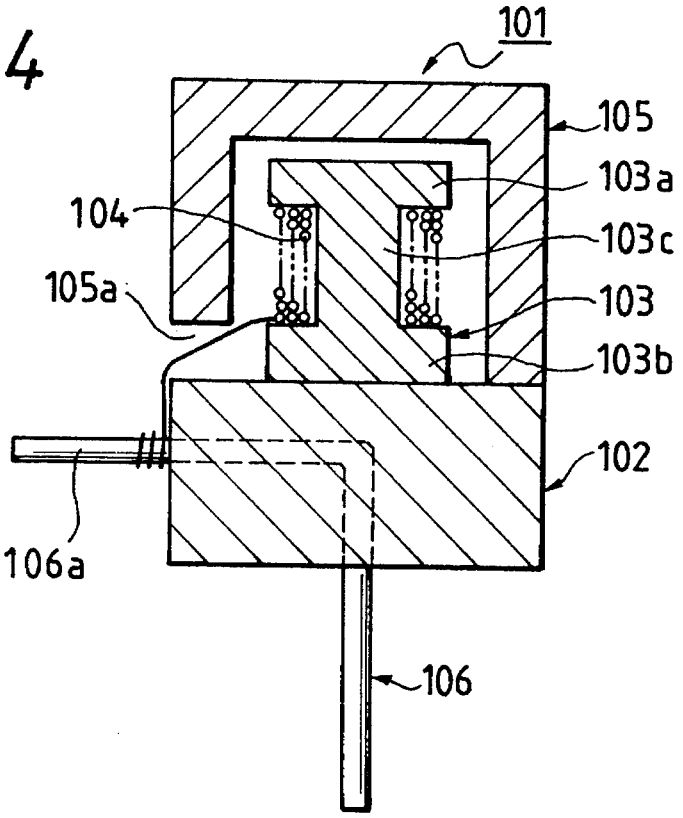
PRIOR ART FIG. 4
FIG. 4 is a sectional view of a conventional coil device.
Figure 5:
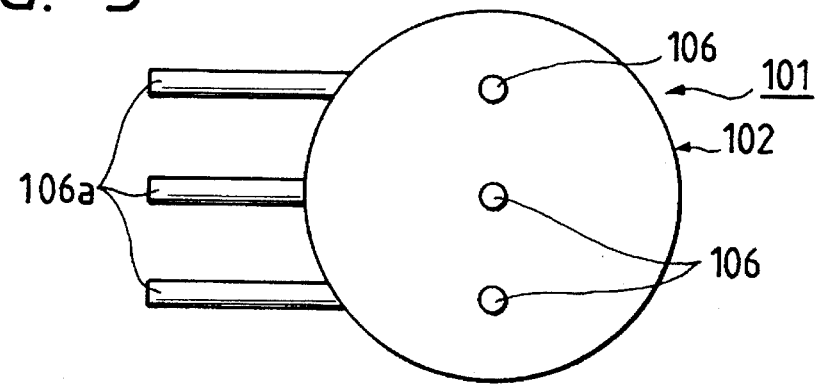
PRIOR ART FIG. 5
FIG. 5 is a bottom view of the coil device of FIG. 4.

Coil devices, which are embodiments of the invention, will now be described with reference to the drawings. FIGS. 1 and 2 show a coil device, which is a first embodiment of the invention; FIG. 1 is a sectional view thereof and FIG. 2 is a bottom view thereof. In FIGS. 1 and 2, reference numeral 12 denotes a ring core made of a magnetic material such as ferrite; 13, a drum core having collars 13*a*, 13*c* and a winding part 13*b* and being made of a magnetic material such as ferrite; 14, a coil formed on the winding part 13*b*; 15, a board having a metallic lead terminal 6 and being made of an insulating material such as a phenol resin or the like; and 17, an adhesive based on epoxy resins.

The board 15 has not only a through hole 15*a* but also a lower surface 15*c* formed, the lower surface 15*c* being lower than a higher surface 15*b*. The lead terminal 16 is inserted into the through hole 15*a* of the board 15, bent at an end of the lower surface 15*c* of the board 15 so that an intermediate part 16*a* of the lead terminal 16 is disposed on the top surface of the board 15. Further, a front end part 16*b* of the lead terminal 16 is bent. An end part 14*a* of the coil 14 is electrically connected to the front end part 16*b*.

The adhesive 17 is interposed between the bottom surface of the drum core 13 and the top surface of the board 15, so that not only the drum core 13 and the board 15 are fixed to each other by the adhesive 17 but the lead terminal 16 is fixed to the drum core 13 or to the board 15 by the adhesive 17 as well. With the lead terminal 16 being fixed rigidly by the adhesive 17 as described above, such a movement of the end part 16*b* of the lead terminal 16 as observed in the conventional example can be blocked, which in turn prevents breakage of the lead terminal due to tensile force of the end part 14*a* of the coil 14.

As described above, the coil device, which is the first embodiment of the invention, wherein a drum core with a coil formed thereon is disposed on a board having a lead terminal, is characterized as arranging the intermediate part of the lead terminal so as to be bent on the board, and fixing the board, the drum core, and the intermediate part of the lead terminal while interposing an adhesive between the board and the drum core. Therefore, even if a strong force is applied to the lead terminal, the movement of the front end part of the lead terminal can be blocked, which in turn prevents unnecessary tensile force from being produced at the end part of the coil, thereby providing the advantage of ensuring a reliable electrical connection between the coil and the lead terminal and other advantages.

Figure 6:
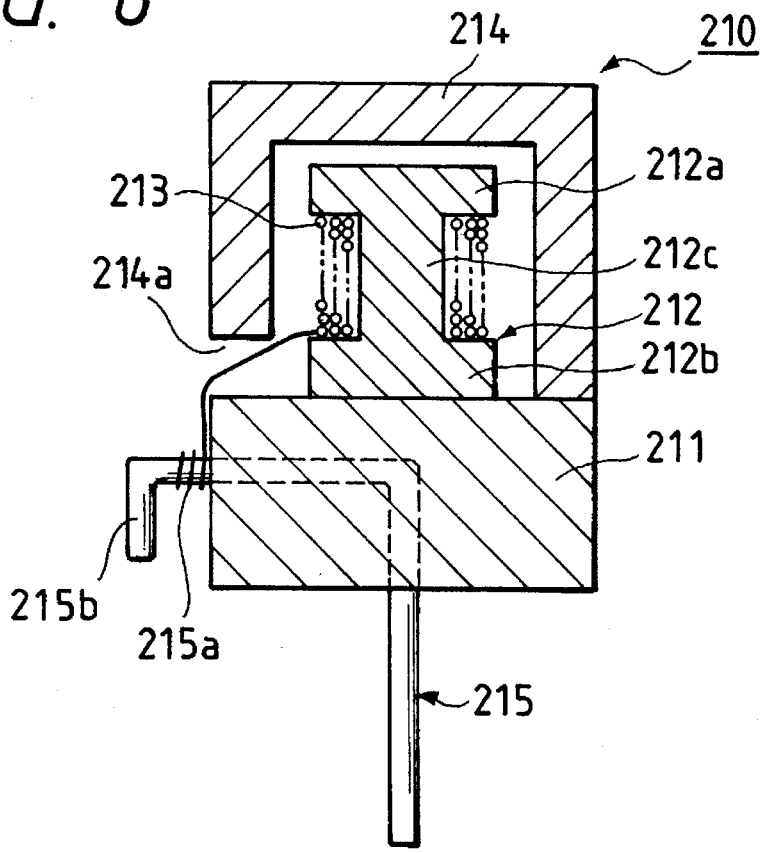
FIG. 6 is a sectional view of a coil device, which is a second embodiment of the invention.
Figure 7:
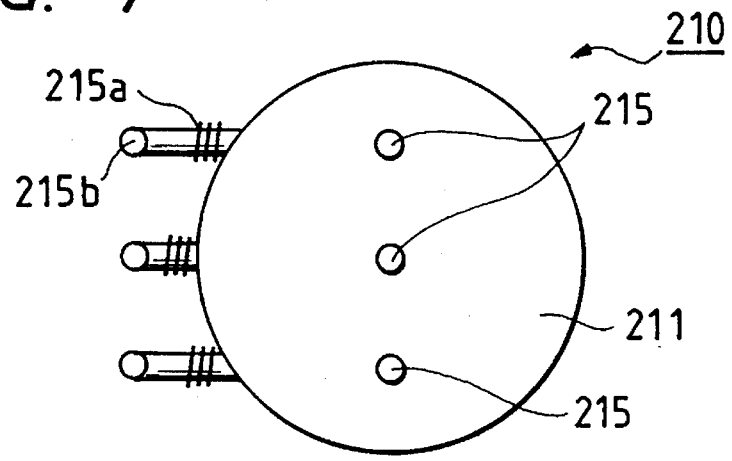
FIG. 7 is a bottom view of the coil device of FIG. 6.

A coil device, which is a second embodiment of the invention, will be described in detail. FIGS. 6 and 7 show the coil device, which is the second embodiment of the invention. A coil device 210 includes: a board 211 made of an insulating material; a drum core 212 being fixed to the top surface of the board 211 by an adhesive or the like and made of a magnetic material such as ferrite; a coil 213 formed on a winding part 212*c* between the upper and lower collars 12*a*, 12*b* of the drum core; a pot core 214 having an open space on the lower end thereof and being arranged so as to enclose the drum core 212; and a plurality of lead terminals 215 (three in the case shown in FIGS. 6 and 7) inserted into the board 112 so as to project toward one side (leftward in the case shown in FIGS. 6 and 7) from the bottom of the board 211 while passing through the board 211.

The winding lead terminal of the coil 213 is led out sideways from the pot core 214 through an open space 214*a* of the pot core 214 arranged at a lower end of the pot core 214. Such a winding lead terminal is bound up around an end part 215*a* of the lead terminal 215 projecting sideways.

As shown in FIGS. 6 and 7, the coil device 210 of the invention is characterized as bending the front end 215*b* of the lead terminal 215 downward so that the end part 215*a* of the lead terminal 215 projecting horizontally sideways from the board 211 extends perpendicularly downward along the way.

The coil device 210, which is the second embodiment of the invention, is constructed as described above, and the end part 215*a* of each lead terminal 215 projecting sideways has the front end thereof 215*b* bent downward. Therefore, the length by which each lead terminal 215 projects sideways from the board 211 is small.

Thus, when the coil device 210 is to be mounted on a mounting board for forming circuits of various devices, the substantial mounting area can be reduced since the end part 215*a* of each lead terminal 215 projects sideways from the board 211 only by a small length. Hence, the mounting board can be downsized.

It may be noted that the winding lead terminal of the coil 213 can be bound up with respect to the end part 215*a* of the lead terminal 215 with ease since the length of the end part 215*a* plus the end part 215*b* as a whole is the same as that in the conventional example.

Figure 8:
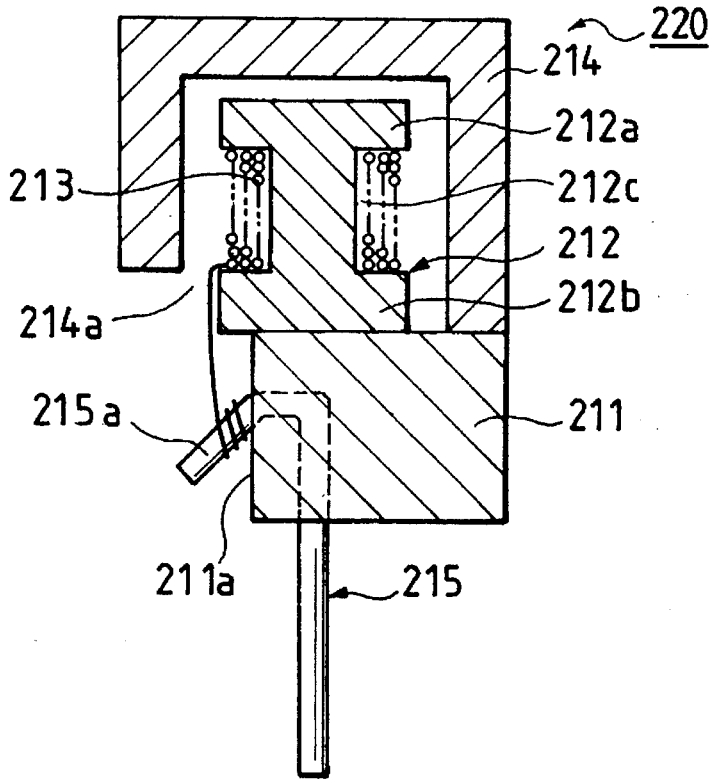
FIG. 8 is a sectional view of a coil device, which is a third embodiment of the invention.
Figure 9:
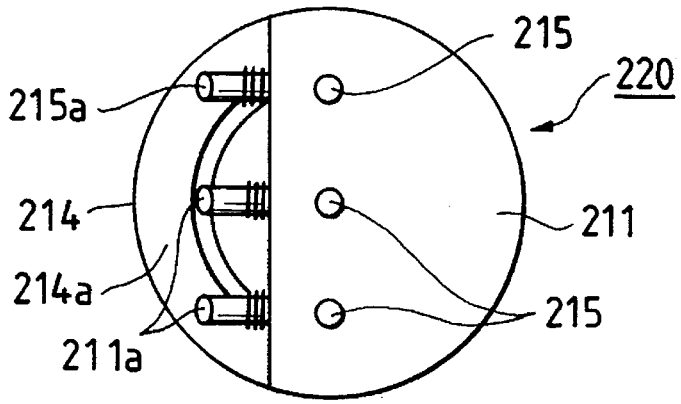
FIG. 9 is a bottom view of the coil device of FIG. 8.

FIGS. 8 and 9 show a coil device, which is a third embodiment of the invention. In FIGS. 8 and 9, the coil device 220 is distinguished from the coil device 210 shown in FIGS. 6 and 7 in that an open space 211*a* is provided on a lateral side of the board 211 from which the end part 215*a* of the lead terminal 215 projects.

According to the thus constructed coil device 220, the end part 215*a* of the lead terminal 215 is bent within the open space 211*a* of the board 211 so as to extend obliquely downward, so that the end part 215*a* of each lead terminal 215 either slightly projects sideways from the board 211 or the pot core 214, or does not project at all as shown in FIGS. 8 and 9.

As a result, when this coil device 220 is to be mounted on a mounting board for forming circuits of various devices, the substantial mounting area is further reduced since the end part 215*a* of each lead terminal 215 projects sideways little from the board 211.

While the front end 215*b* of the end part 215*a* of the lead terminal 215 is bent so as to extend perpendicularly downward in the coil device 210 shown in FIGS. 6 and 7, the entire part of the end part 215*a* projecting sideways from the board 211 may be bent so as to extend obliquely downward in a manner similar to the coil device 220 shown in FIGS. 8 and 9.

Similarly, while the end part 215*a* of the lead terminal 215 is bent so as to extend obliquely downward in the coil device 220 shown in FIGS. 8 and 9, the end part 215*a* projecting sideways from the open space 211*a* of the board 211 may be bent so as to extend perpendicularly downward along the way in a manner similar to the coil device 210 shown in FIGS. 6 and 7.

As described above, the second and third embodiments are characterized as bending downward the end part of the lead terminal projecting sideways from the board around which the winding lead terminal of the coil formed on the drum core is bound up. Therefore, the length by which the lead terminal projects sideways from the board is shortened, which in turn contributes to reducing the substantial mounting area when this coil device is to be mounted on a mounting board. As a result, an extremely excellent coil device whose lead terminal does not project sideways so much can be provided.

What is claimed is:

1. A coil device comprising:

an insulating board;

a drum core disposed on the board, the drum on which a coil is wound;

at least one lead terminal passing through the insulating board from the bottom surface of the insulating board, the lead terminal projecting sideways; and an adhesive layer interposed between the insulating board and the drum core, the lead terminal projecting sideways positioned in the adhesive layer.

2. A coil device as claimed in claim 1, wherein an end part of the lead projecting sideways is bent downward.

3. A coil device as claimed in claim 1, wherein an open space is provided on a lateral side of the insulating board toward which the end part of the lead terminal projects sideways.

4. A coil device as claimed in claim 2, wherein an open space is provided on a lateral side of the insulating board toward which the end part of the lead terminal projects sideways.

5. A coil device as claimed in claim 2, wherein the end part of the lead terminal projecting sideways is bent obliquely downward.

6. A coil device as claimed in claim 2, wherein the end part of the lead terminal projecting sideways is bent perpendicularly downward.

* * * * *